US006860837B2

(12) United States Patent
Chang

(10) Patent No.: US 6,860,837 B2
(45) Date of Patent: Mar. 1, 2005

(54) SURFING EXERCISER

(76) Inventor: Huang-Tung Chang, P.O. Box 487, Chang-Hua City (TW), 500

( * ) Notice: Subject to any disclaimer, the term of this patent is extended or adjusted under 35 U.S.C. 154(b) by 0 days.

(21) Appl. No.: 10/671,726

(22) Filed: Sep. 29, 2003

(65) Prior Publication Data

US 2005/0026753 A1 Feb. 3, 2005

(30) Foreign Application Priority Data

Jul. 29, 2003 (TW) ..... 92213747 U

(51) Int. Cl.[7] ..... A63B 21/00; A61H 1/00
(52) U.S. Cl. ..... 482/51
(58) Field of Search ..... 482/51–53, 57, 482/70, 79; 601/27, 31–32, 23–24, 35; 434/255, 247; 472/117; 446/396

(56) References Cited

U.S. PATENT DOCUMENTS 2,603,486 A * 7/1952 Hughes ..... 482/110
3,370,584 A * 2/1968 Girten ..... 601/31
4,185,622 A * 1/1980 Swenson ..... 601/27
4,842,265 A * 6/1989 Kirk ..... 601/31
5,529,555 A * 6/1996 Rodgers, Jr. ..... 482/57
5,593,380 A * 1/1997 Bittikofer ..... 601/27

* cited by examiner

*Primary Examiner*—Stephen R. Crow

(57) ABSTRACT

A surfing exerciser includes a base on the floor and a motor is disposed on the base with a wheel connected to an end of the motor and driven by the motor. A fame is disposed on the base and an arm has a first end pivotably connected to the frame. A second end of the arm is pivotally connected to a first end of a link, and a second end of the link is eccentrically pivotably connected to the wheel. A board is pivotably connected to the link so that a user stands on the board and the board is moved along a ∞-shaped path when the motor is activated.

4 Claims, 17 Drawing Sheets

SURFING EXERCISER

FIELD OF THE INVENTION

The present invention relates to a surfing exerciser which employs links connected between a servo motor and a board which is moved along a ∞-shaped path so as to provide the user a imitation of surfing.

BACKGROUND OF THE INVENTION

A conventional exercisers that have pedals include step mounting exerciser and elliptical exerciser. The step mounting exercisers allow the user to alternately step the pedals along a substantially circular path and the elliptical exercisers allow the user to move legs in an elliptical path. These types of movement are not satisfied by the users and new type of movement is needed in the market.

The present invention intends to provide a surfing exerciser which has a board and the user stands on the board with his or her tow legs. The movement of the board is along a ∞-shaped path so that the user feels like surfing and may enjoy a new type of movement.

SUMMARY OF THE INVENTION

In accordance with one aspect of the present invention, there is provided a surfing exerciser which includes a base with a motor is disposed thereon and a wheel is connected to an end of the motor and driven by the motor. A frame is disposed on the base and an arm has a first end pivotably connected to the frame. A second end of the arm is pivotally connected to a first end of a link, and a second end of the link is eccentrically pivotably connected to the wheel. A board is pivotably connected to the link. The board is moved along a ∞-shaped path when the motor is activated.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 2–1 shows the board is rotatably connected to the first end of the link;

FIG. 2—2 shows two pedals are pivotably connected to the board;

DETAILED DESCRIPTION OF THE PREFERRED EMBODIMENT

Figure 1:
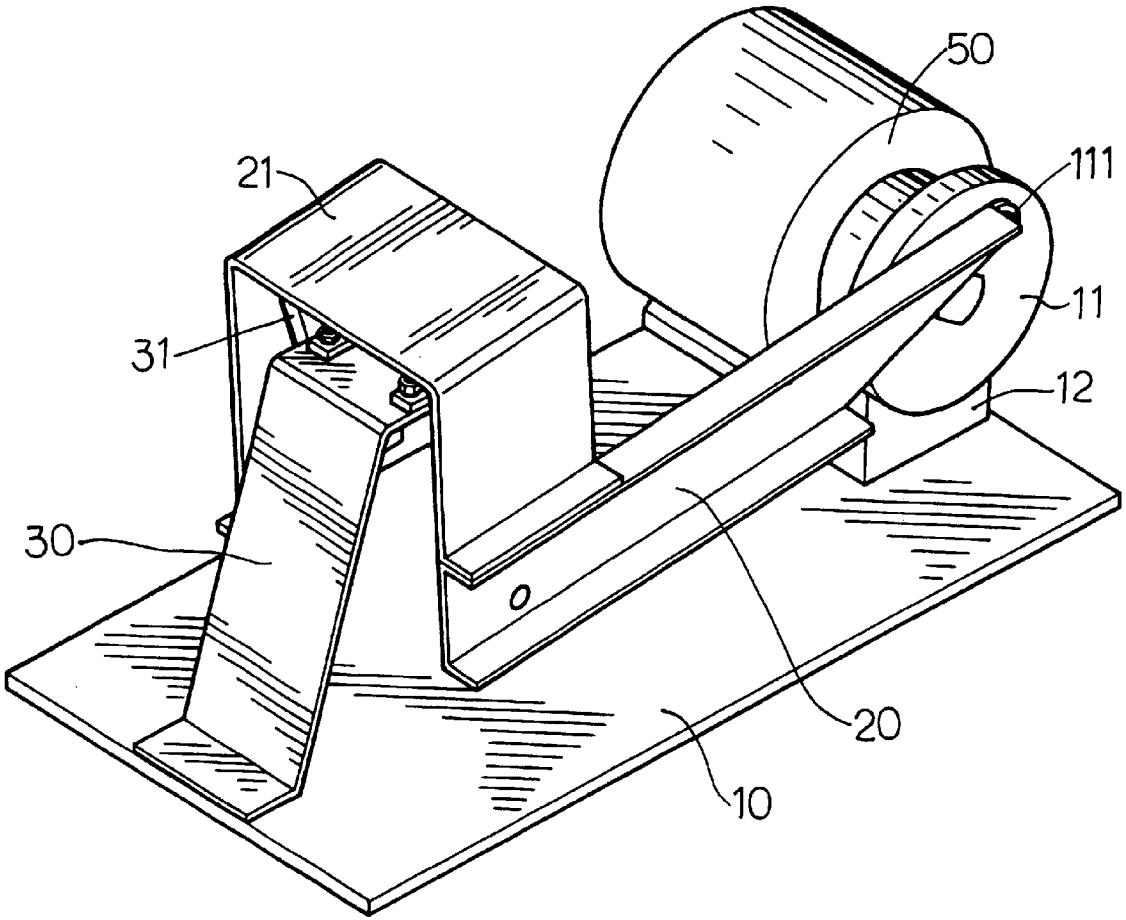
FIG. 1 is a perspective view to show the main structure of the surfing exerciser of the present invention.
Figure 2:
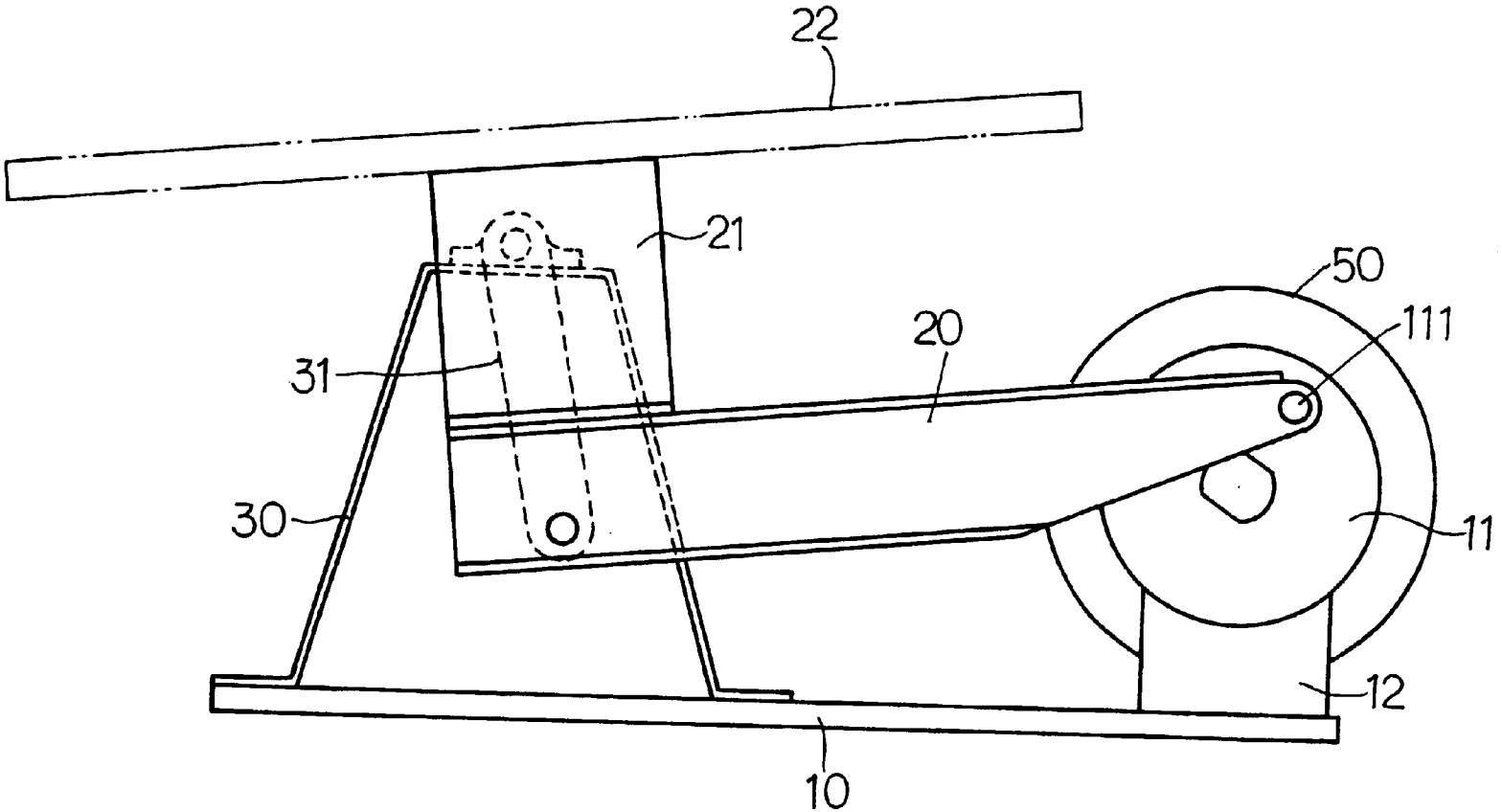
FIG. 2 is a side view to show the arm in the main structure of the surfing exerciser of the present invention.
Figures 1, 2:
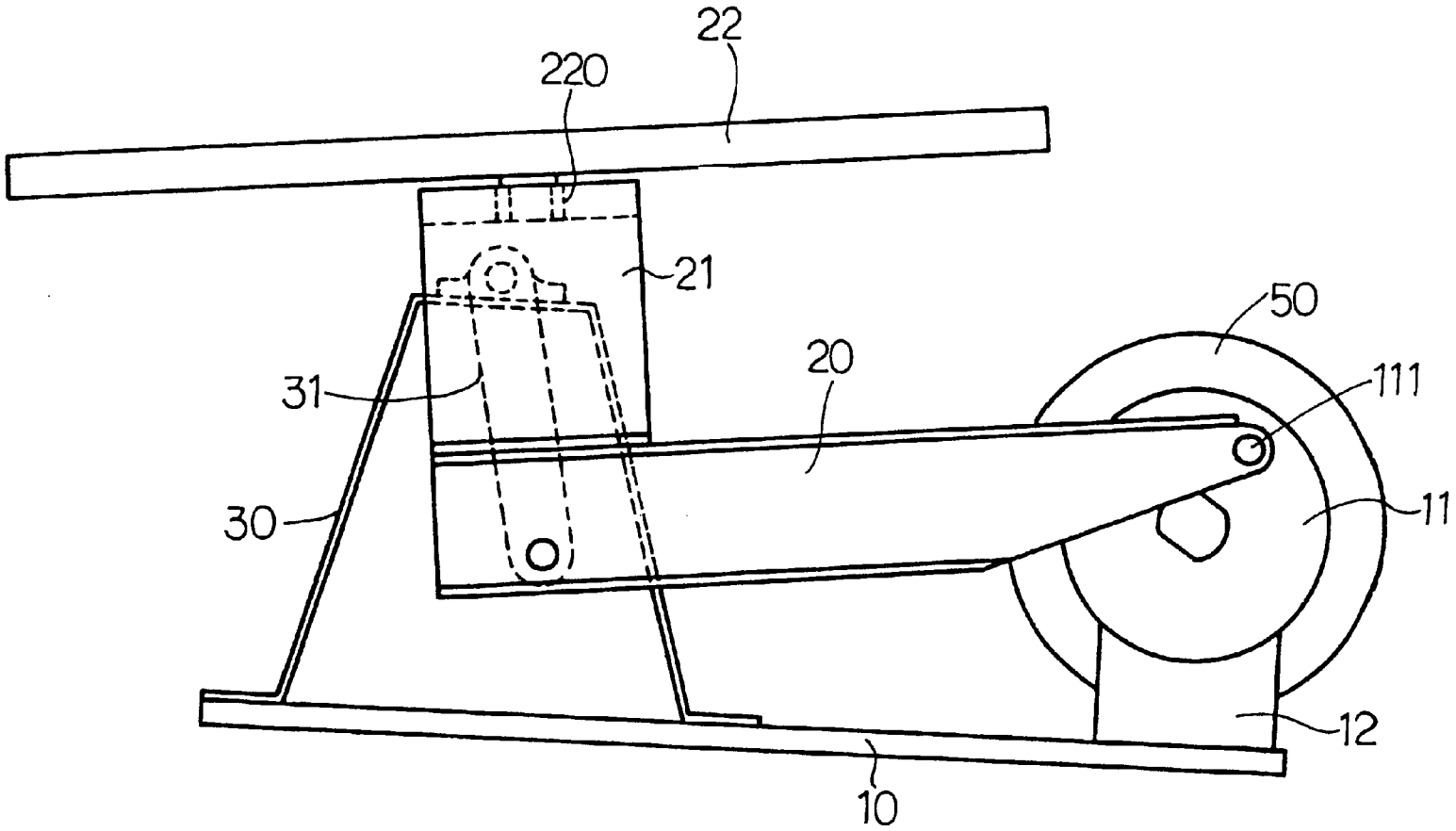
Figure 2:
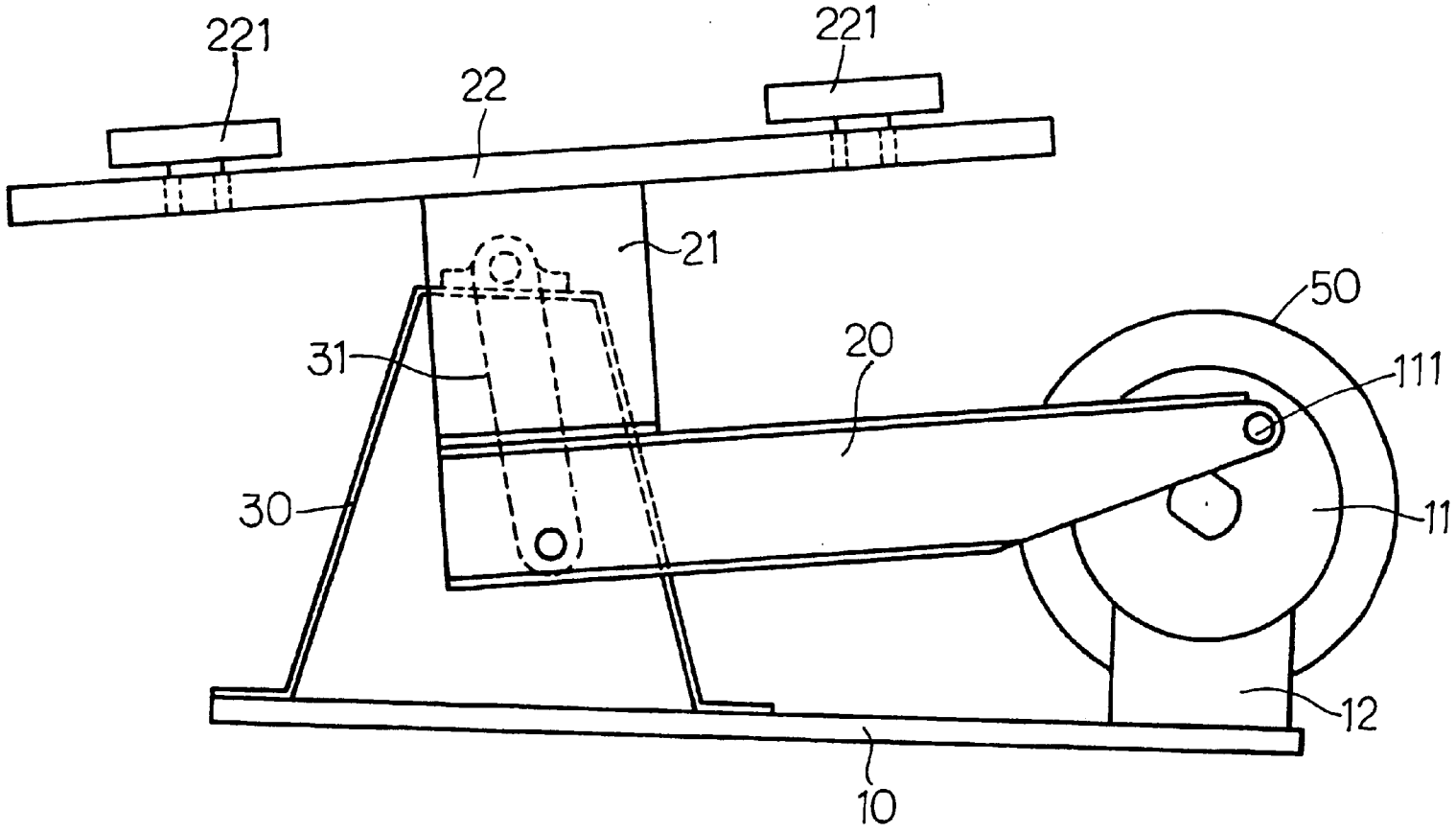

Referring to FIGS. 1 and 2, the surfing exerciser of the present invention comprises a base 10 put on the floor and a support base 12 with a servo motor 50 disposed thereon are disposed on the base 10. A wheel 11 is connected to an end of the motor 50 and driven by the motor 50.

A frame 30 is disposed on the base 10 and an arm 31 having a first end pivotably connected to the frame 30 by a bearing. A second end of the arm 31 pivotally connected to a first end of a link 20. The first end of the link 20 is a U-shaped connection member 21 which includes a top surface and a board 22 is disposed on the top surface of the link 20. A second end of the link 20 is eccentrically pivotably connected to the wheel 11 at the pivot point 111.

As shown in FIG. 2–1, pivotal devices 220 are disposed between the board 22 and the link 23 so that the board 22 can be moved relative to the first end of the link 20. As shown in FIG. 2—2, two pedals 221 are pivotably connected to the board 22 so that the user may stand on the two pedals 221 by two feet and the two pedals 221 are moved relative to the board 22.

Figure 3:
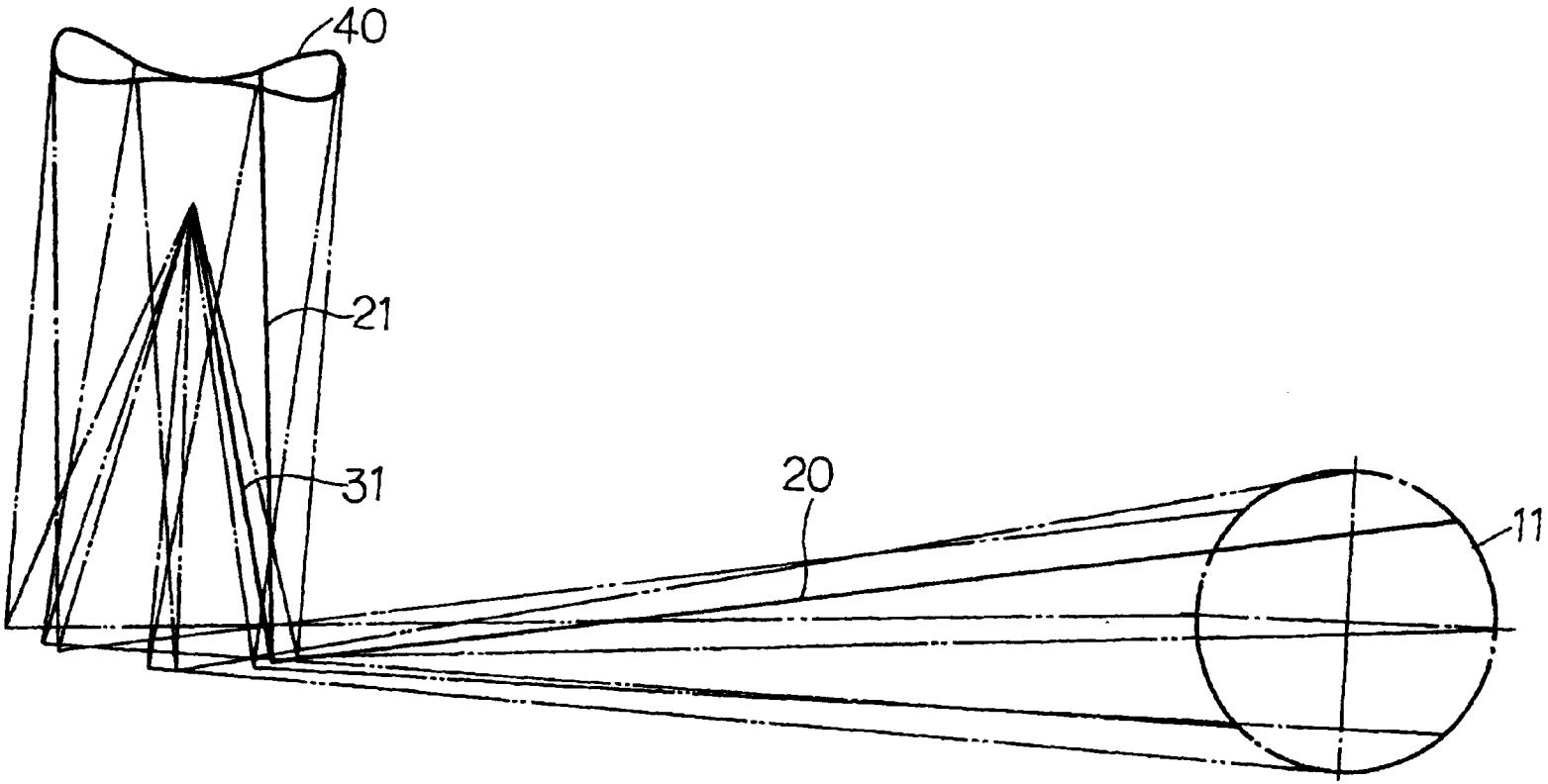
FIG. 3 shows the path of movement of the link, the connection member on the link, the arm and the board of the surfing exerciser of the present invention as shown in FIG. 2.

Referring to FIG. 3, when the wheel 11 is rotated by the motor 50, the path of movement of the link 20, the connection member 21 on the link 20, the arm 31 and the board 22 of the surfing exerciser of the present invention is shown. The board 22 is moved along a ∞-shaped path.

Figure 4:
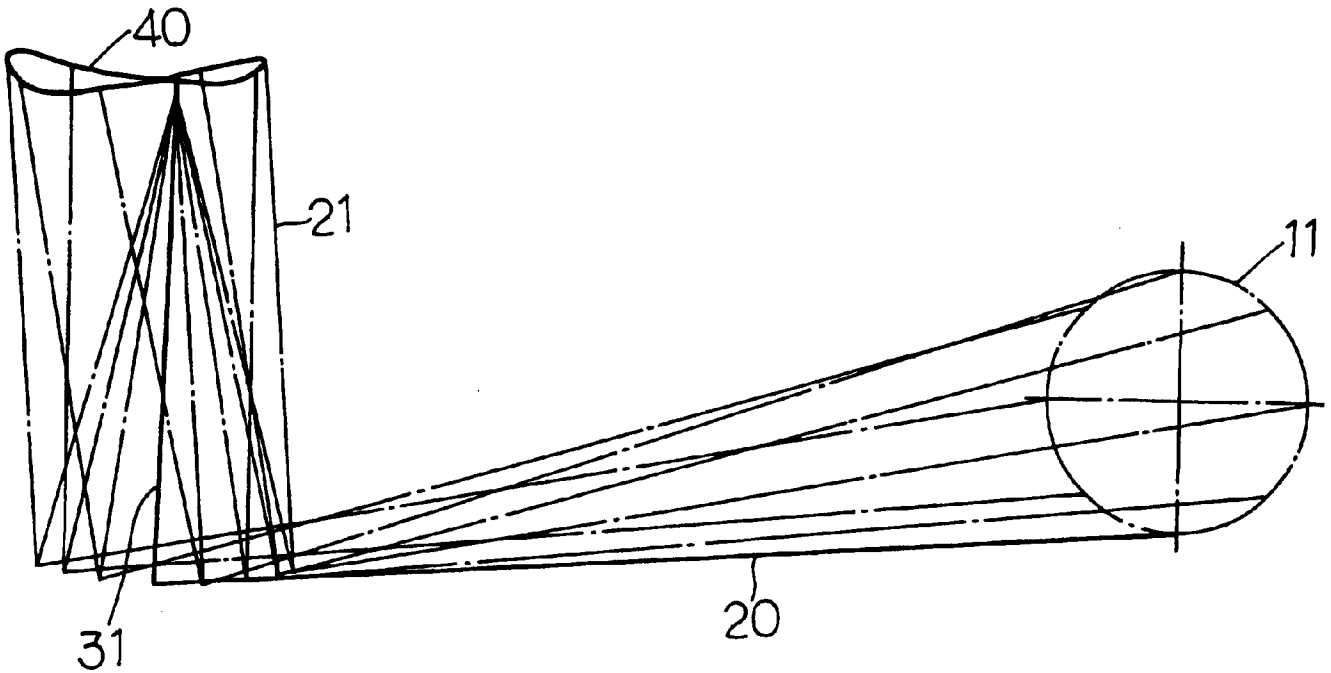
FIG. 4 shows the path of movement of the link, the connection member on the link, the arm and the board of the surfing exerciser of the present invention as the length of the arm is increased.
Figure 5:
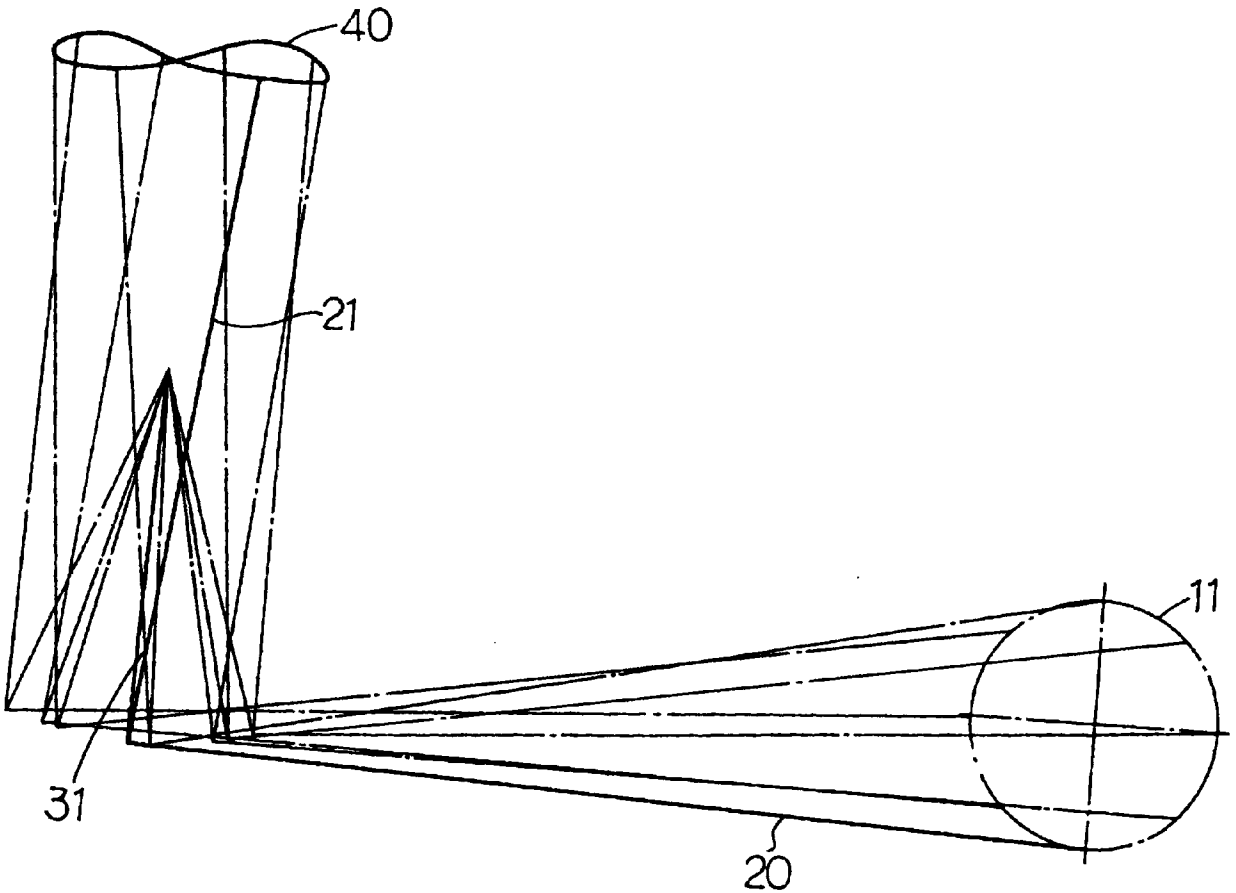
FIG. 5 shows the path of movement of the link, the connection member on the link, the arm and the board of the surfing exerciser of the present invention as the length of the arm is reduced.

FIG. 4 shows the path of movement of the link 20, the connection member 21 on the link 20, the arm 31 and the board 22 of the surfing exerciser as the length of the arm 31 is increased. FIG. 5 shows the path of movement of the link 20, the connection member 21 on the link 20, the arm 31 and the board 22 of the surfing exerciser as the length of the arm 31 is reduced.

Figure 6:
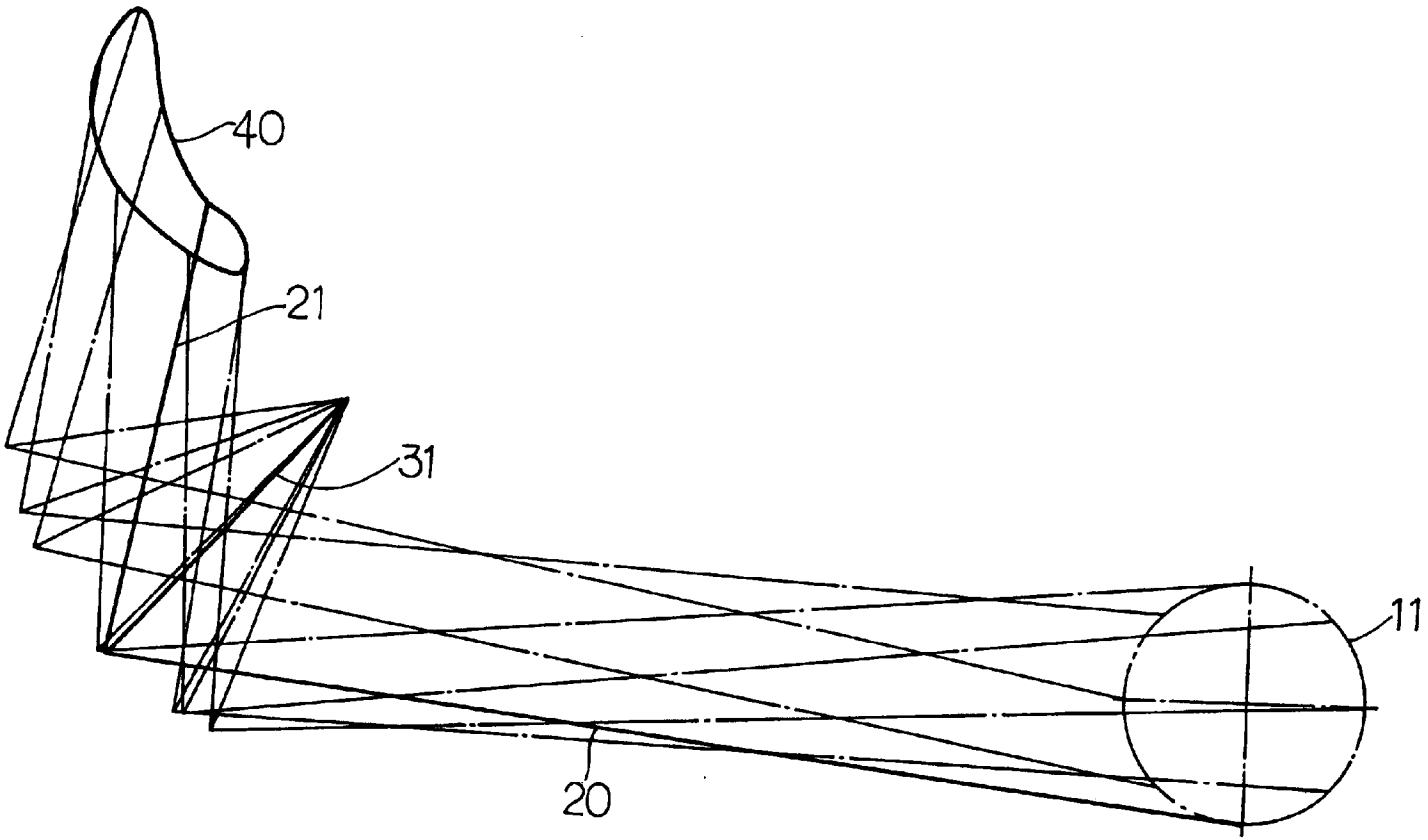
FIG. 6 shows the path of movement of the link, the connection member on the link, the arm and the board of the surfing exerciser of the present invention as the length of the link is increased.
Figure 7:
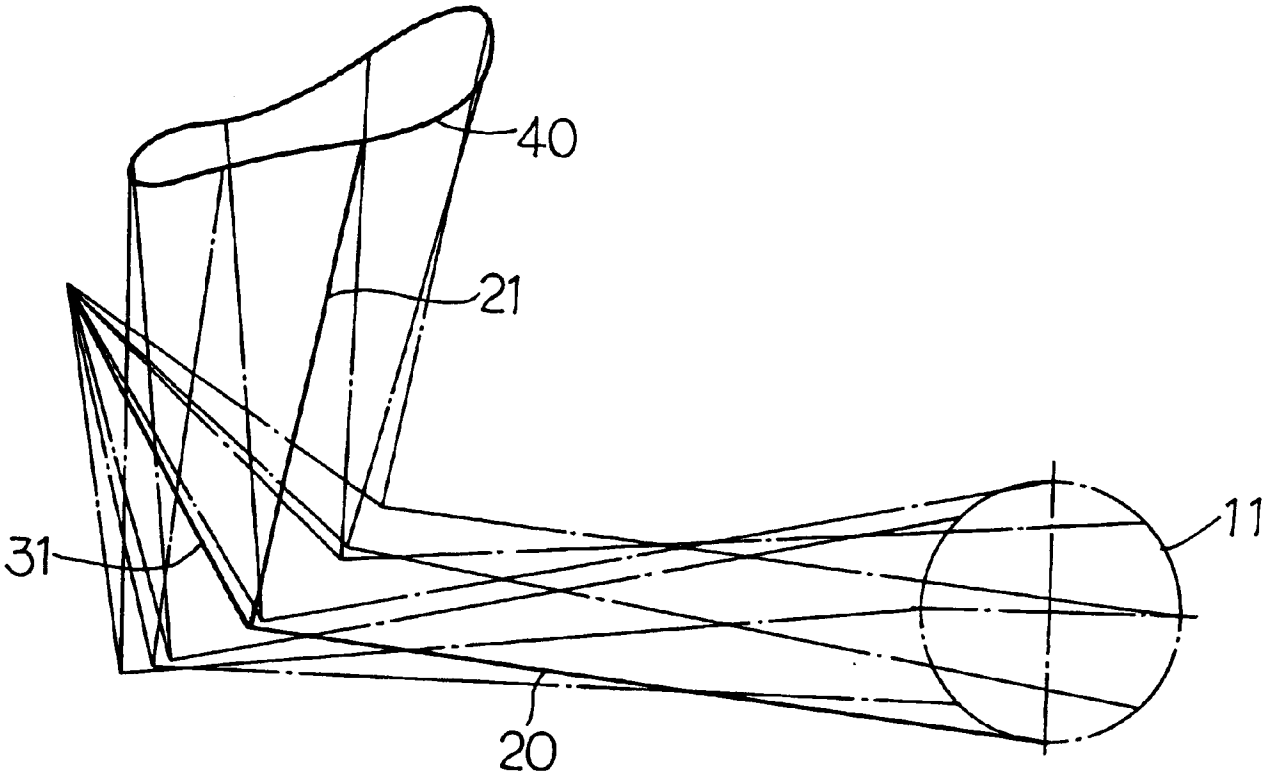
FIG. 7 shows the path of movement of the link, the connection member on the link, the arm and the board of the surfing exerciser of the present invention as the length of the link is reduced.
Figure 8:
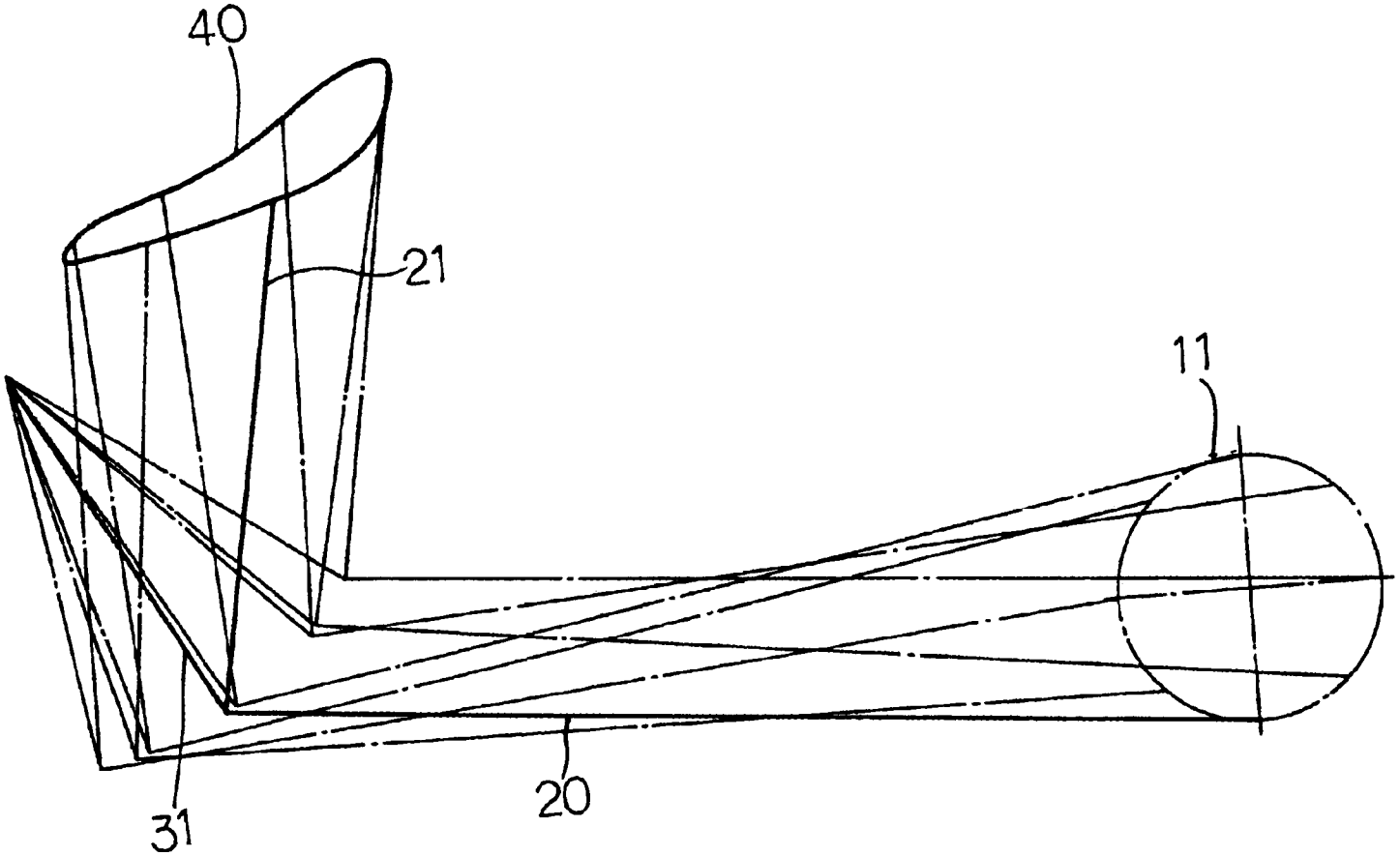
FIG. 8 shows the path of movement of the link, the connection member on the link, the arm and the board of the surfing exerciser of the present invention as the length between the arm and the motor is increased.
Figure 9:
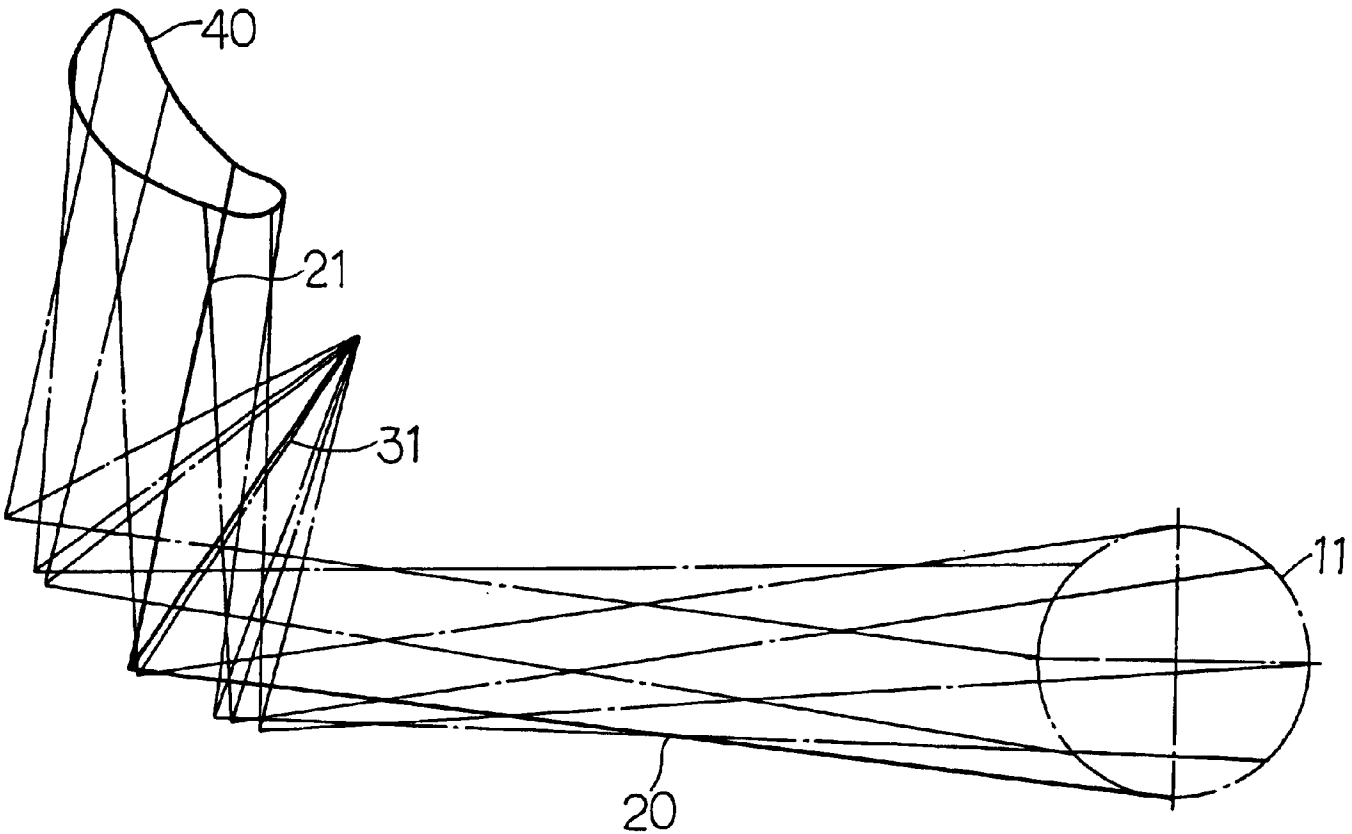
FIG. 9 shows the path of movement of the link, the connection member on the link, the arm and the board of the surfing exerciser of the present invention as the length between the arm and the motor is reduced.

FIG. 6 shows the path of movement of the link 20, the connection member 21 on the link 20, the arm 31 and the board 22 of the surfing exerciser as the length of the link 20 is increased. FIG. 7 shows the path of movement of the link 20, the connection member 21 on the link 20, the arm 31 and the board 22 of the surfing exerciser as the length of the link 20 is reduced, FIG. 8 shows the path of movement of the link 20, the connection member 21 on the link 20, the arm 31 and the board 22 of the surfing exerciser as the length between the arm 31 and the motor 50 is increased. FIG. 9 shows the path of movement of the link 20, the connection member 21 on the link 20, the arm 31 and the board 22 of the surfing exerciser as the length between the arm 31 and the motor 50 is reduced.

Figure 10:
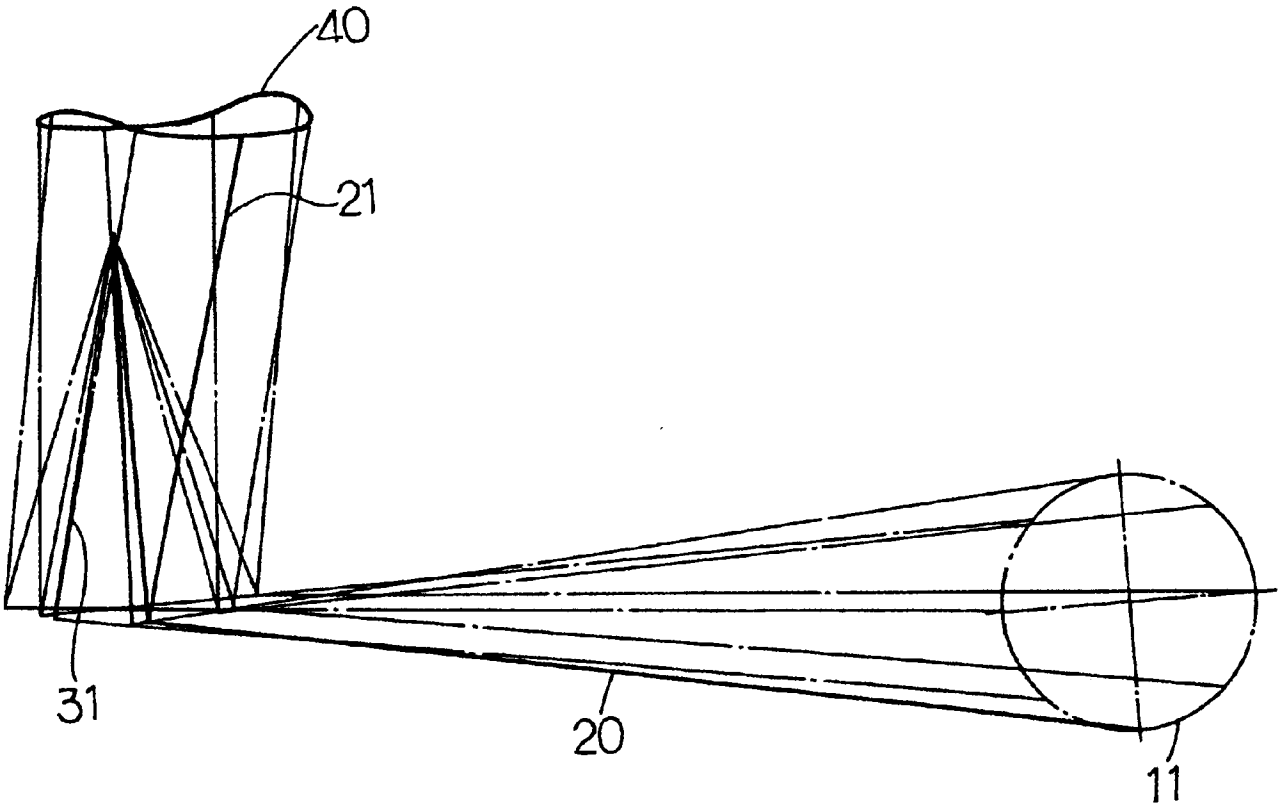
FIG. 10 shows the path of movement of the link, the connection member on the link, the arm and the board of the surfing exerciser of the present invention as the height between the first end of arm and the center of the wheel is increased.
Figure 11:
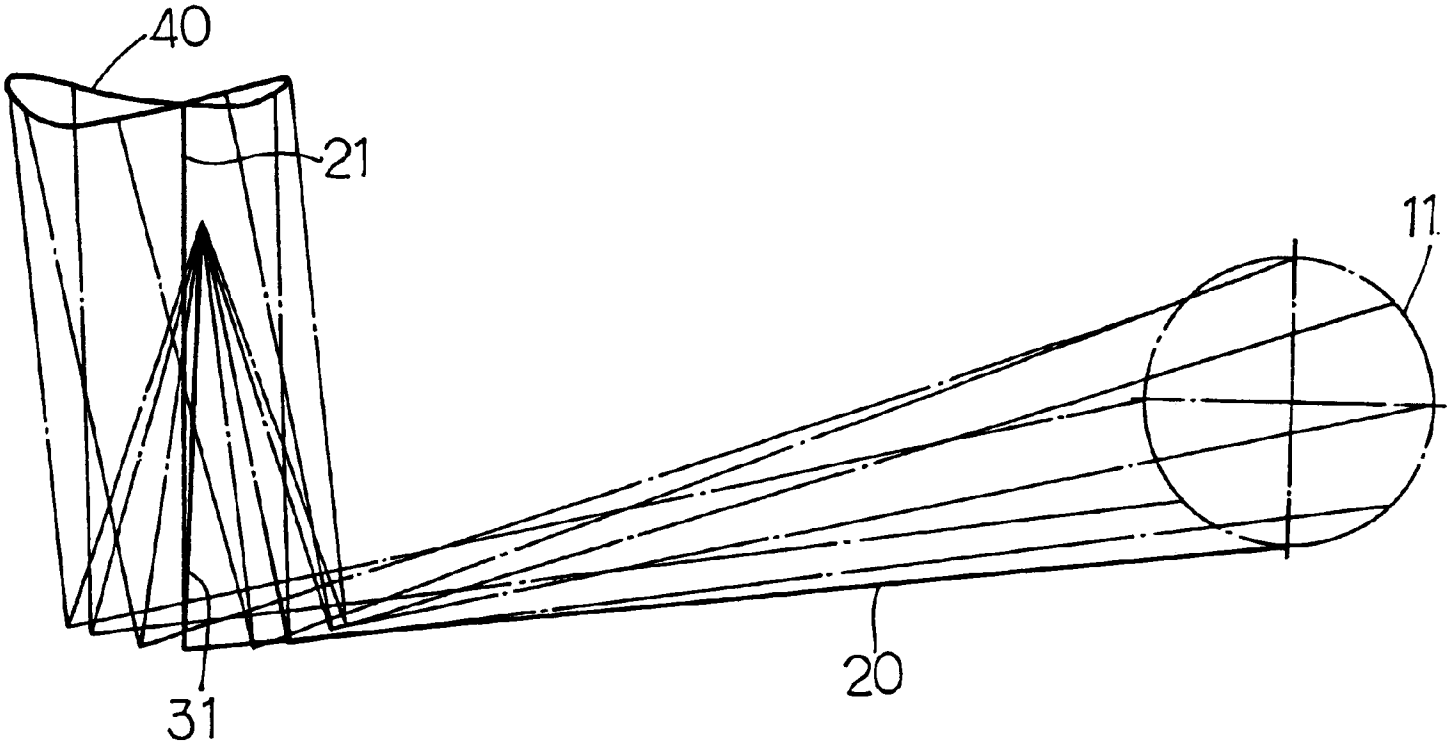
FIG. 11 shows the path of movement of the link, the connection member on the link the arm and the board of the surging exerciser of the present invention as the height between the first end of arm and the center of the wheel is reduced.
Figure 12:
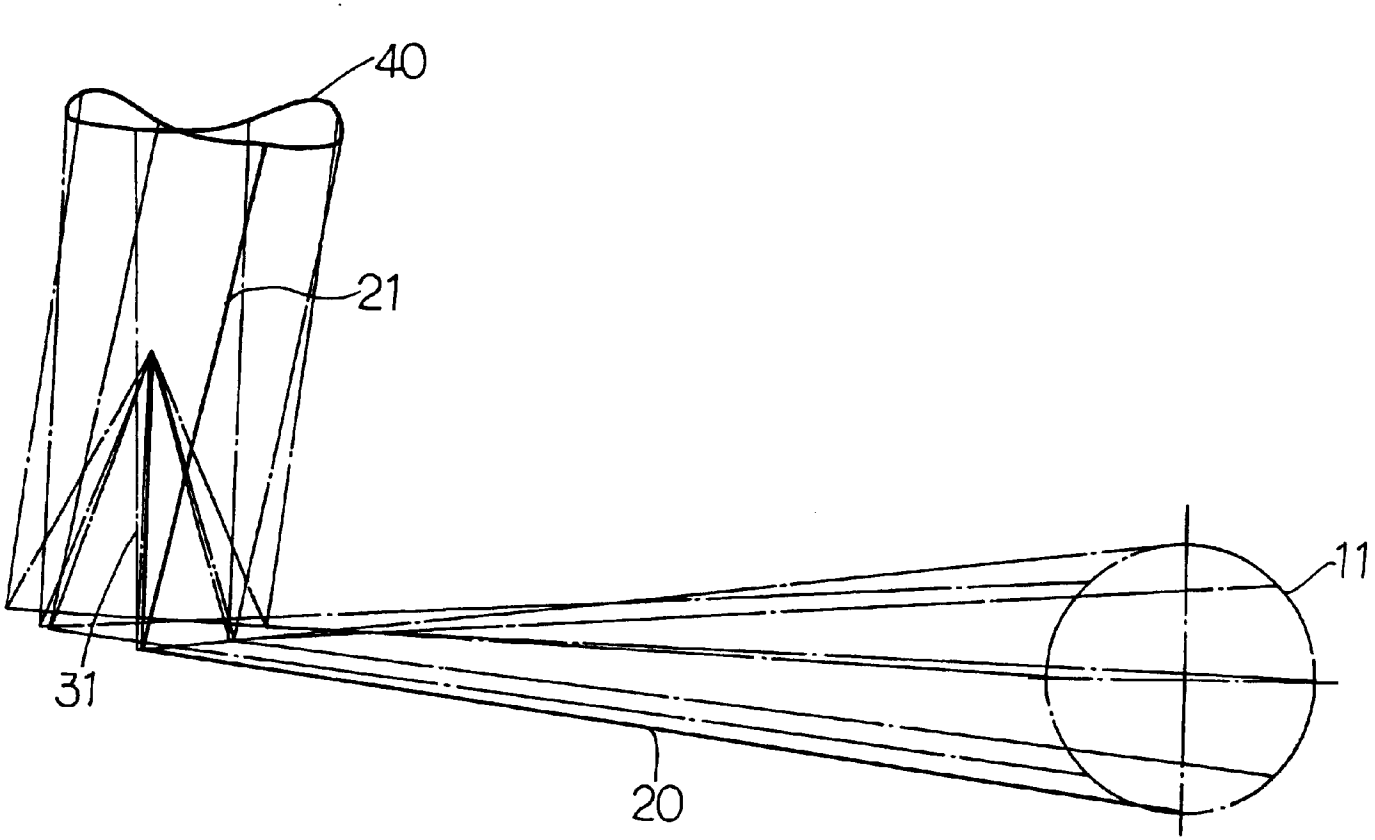
FIG. 12 shows the path of movement of the link, the connection member on the link, the arm and the board of the surfing exerciser of the present invention as the height of the frame is increased.
Figure 13:
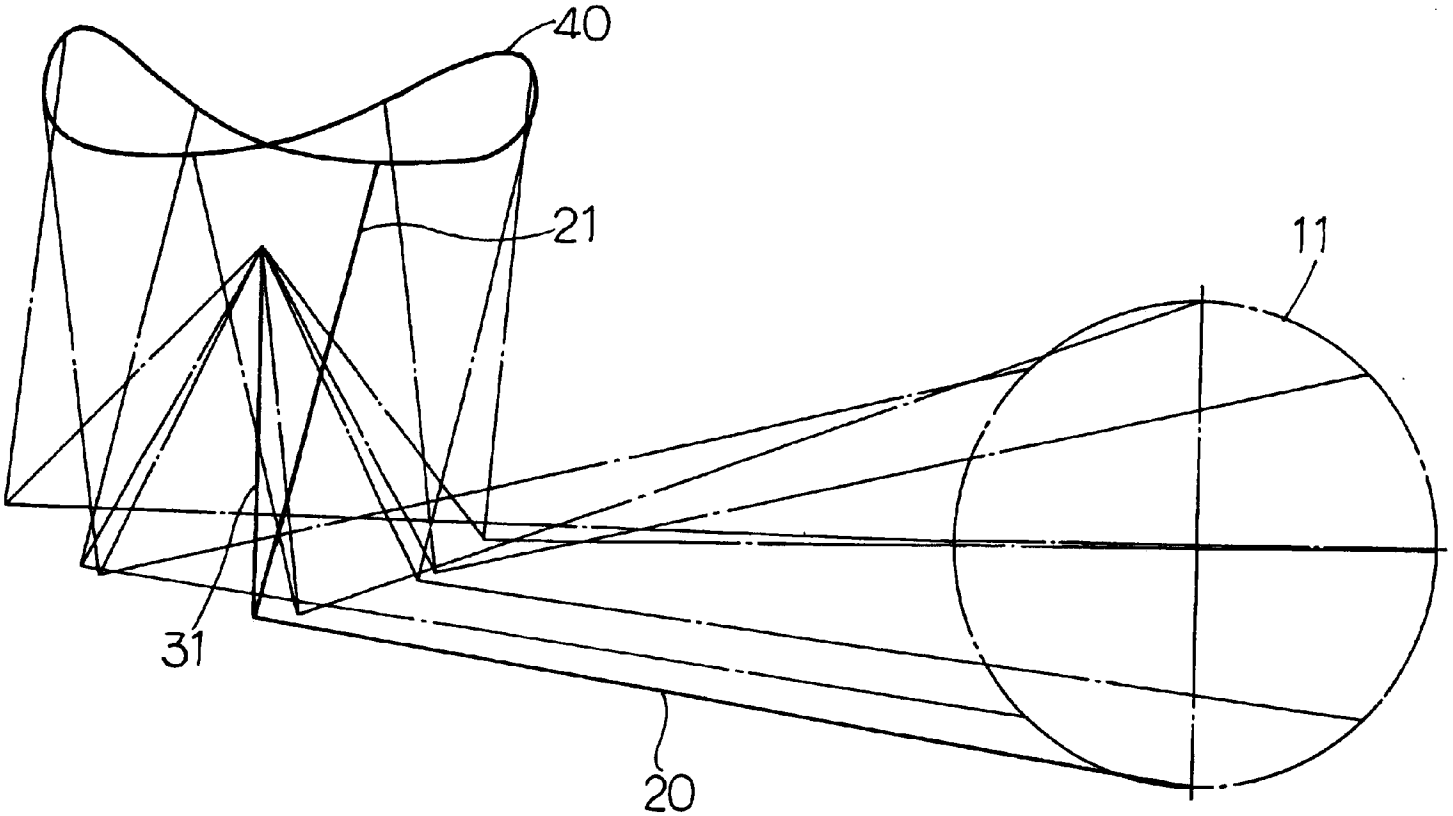
FIG. 13 shows the path of movement of the link, the connection member on the link, the arm and the board of the surfing exerciser of the present invention as the diameter of the wheel is reduced.

FIG. 10 shows the path of movement of the link 20, the connection member 21 on the link 20 the arm 31 and the board 22 of the surfing exerciser as the height between the first end of arm 31 and the center of the wheel 11 is increased. FIG. 11 shows the path of movement of the link 20, the connection member 21 on the link 20, the arm 31 and the board 22 of the swing exerciser as the height between the first end of arm 31 and the center of the wheel 11 is reduced FIG. 12 shows the path of movement of the link 20, the connection member 21 on the link 20, the arm 31 and the board 22 of the surfing exerciser as the height of the frame 30 is increased. FIG. 13 shows the path of movement of the link 20, the connection member 21 on the link 20, the arm 31 and the board 22 of the surfing exerciser as the height of the frame 30 is reduced.

Figure 14:
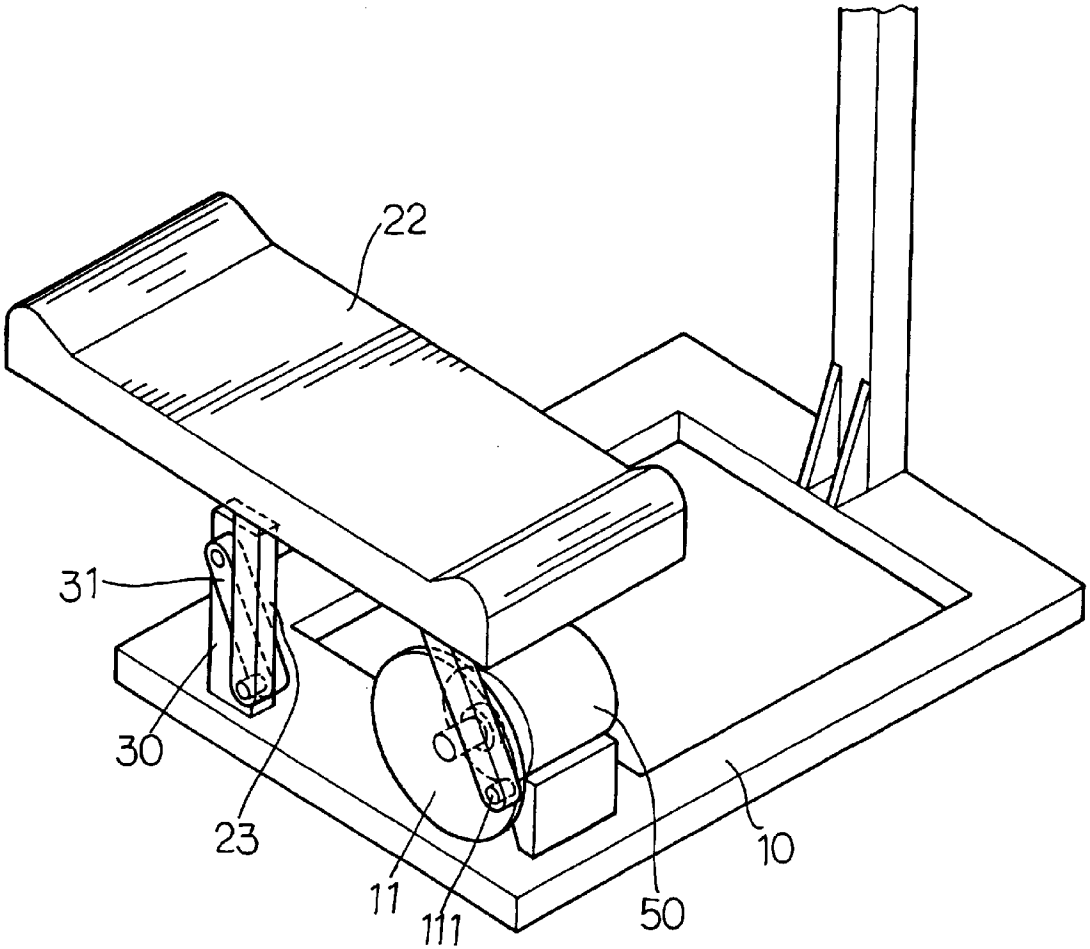
FIG. 14 shows another embodiment of the surfing exerciser of the present invention.
Figure 15:
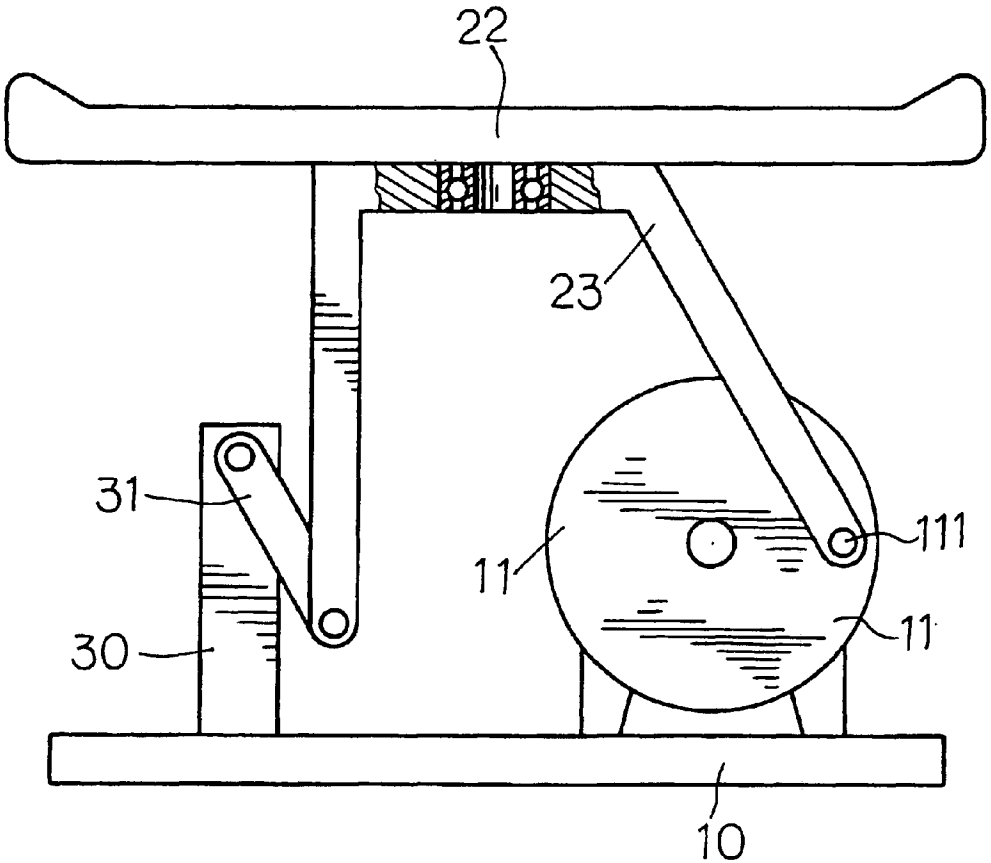
FIG. 15 shows a side view of the surfing exerciser of the present invention.

FIGS. 14 and 15 shows another embodiment of the present invention wherein the link 20 and the connection member 21 of the first end of the link 20 replaced by a U-shaped link 23 which includes a horizontal portion on which the board 22 is disposed. It is to be noted that a resistance device such as a magnetic-resistance device can be used to increase the resistance of the rotation of the wheel 11 so as to enhance different functions of exercise.

By this specific type of movement of the board 22 or the pedals 221, user moves like surfing on waves and the enjoys more pose changes of movement of his or her body.

While we have shown and described the embodiment in accordance with the present invention, it should be clear to those skilled in the art that further embodiments may be made without departing from the scope of the present invention.

What is claimed is:

1. A surfing exerciser comprising:

a base with a motor disposed on the base, a wheel connected to an end of the motor and driven by the motor;

a frame disposed on the base and an arm having a first end pivotably connected to the frame, a second end of the arm pivotally connected to a first end of a link, a second end of the link eccentrically pivotably connected to the wheel, and a board pivotably connected to the link.

2. The exerciser as claimed in claim 1, wherein the first end of the link includes a top surface and the board is disposed on the top surface of the link.

3. The exerciser as claimed in claim 1, wherein pivotal devices are disposed between the board and the link.

4. The exerciser as claimed in claim 1 further comprising two pedals which are pivotably connected to the board.

* * * * *